United States Patent [19]

Sullivan et al.

[11] Patent Number: 4,483,246

[45] Date of Patent: Nov. 20, 1984

[54] APPARATUS FOR CRUSHING METAL CONTAINERS AND ASSOCIATED METHOD

[75] Inventors: Patrick J. Sullivan; Richard J. White; Lloyd M. Bigley, all of Pittsburgh, Pa.

[73] Assignee: Weinman Pump & Supply Company, Pittsburgh, Pa.

[21] Appl. No.: 360,792

[22] Filed: Mar. 22, 1982

[51] Int. Cl.[3] ..... B30B 9/32

[52] U.S. Cl. ..... 100/35; 100/3; 100/45; 100/218; 100/902; 206/83.5; 206/598

[58] Field of Search ..... 100/902, 216, 249, 99, 100/45, 3, 35, 295, 901, 218; 206/83.5, 386, 598, 599

[56] References Cited

U.S. PATENT DOCUMENTS

| | | | |
|---|---|---|---|
| 1,376,757 | 5/1921 | Graham | 100/35 X |
| 2,570,757 | 10/1951 | Bowman et al. | 100/3 X |
| 2,595,503 | 5/1952 | Altgelt | 100/30 X |
| 3,089,410 | 5/1963 | Stangl | 100/249 |
| 3,237,554 | 3/1966 | Davis Jr. | 100/901 X |
| 3,266,096 | 8/1966 | Thomas et al. | 100/99 |
| 3,585,925 | 6/1971 | Fox | 100/249 |
| 3,613,558 | 10/1971 | Math | 100/35 |
| 3,752,061 | 8/1973 | Hirsch | 100/45 X |
| 3,765,321 | 10/1973 | Newell | 100/249 X |
| 3,908,538 | 9/1975 | Boyd | 100/218 X |
| 3,991,670 | 11/1976 | Stromberg | 100/3 X |
| 4,201,128 | 5/1980 | Whitehead et al. | 100/218 X |
| 4,337,694 | 7/1982 | Brown | 100/45 |

FOREIGN PATENT DOCUMENTS

| | | | |
|---|---|---|---|
| 4615270 | 4/1971 | Japan | 100/295 |

*Primary Examiner*—Billy J. Wilhite
*Assistant Examiner*—Christine A. Peterson
*Attorney, Agent, or Firm*—Arnold B. Silverman

[57] ABSTRACT

Apparatus for crushing a plurality of metal containers into a unitary compacted unit and the method associated therewith. A first power operated ram which reciprocates within a compaction chamber. A supply of cans is introduced into the compaction chamber preferably by a predetermined weight measurement. The door between the supply source and the compaction chamber is operated by movement of the ram and its associated platen. Each sequential charge of cans is compressed in the compaction chamber until a compacted unit of predetermined size and weight is established. In another embodiment depressions may be provided to eliminate the need for pallets in handling groups of compacted units. A moveable floor member is opened to permit the compacted unit to be delivered to an underlying discharge chamber. A second powered ram moves the compacted unit out of the compactor while preferably, simultaneously restoring the floor to a closed position.

15 Claims, 9 Drawing Figures

APPARATUS FOR CRUSHING METAL CONTAINERS AND ASSOCIATED METHOD

BACKGROUND OF THE INVENTION

1. Field of the Invention

This invention relates to apparatus and an associated method for the automated compaction of metal containers into unitary, high density articles.

2. Description of the Prior Art

In recent years, as a result of high cost of energy and related storage of certain types of fuel, various efforts have been made to conserve energy through adoption of more energy efficient practices. With a view toward these objectives, it has been suggested to attempt to recycle metal containers in order that the metal may be reclaimed with less use of energy than was required in the original ore processing. A major effort to recycle aluminum cans has evolved. A high percentage of the total energy required to produce a pound of aluminum is consumed in the original refining and smelting operation, while only a small fraction of this amount of energy is required to reclaim aluminum from used aluminum cans.

As a result of the empty cans occupying such a great volume, it is impractical to return the same to a remelting center in the can's original structural shape. It is necessary, therefore, to employ efficient and economical practices which can process large volumes of cans in an automated fashion.

U.S. Pat. No. 4,084,496 discloses apparatus for sequentially crushing individual containers and subsequently separating aluminum from steel beverage cans by means of magnetic rollers. The individual crushed cans are then dropped into separate containers in loose form.

U.S. Pat. No. 4,091,725 also discloses apparatus for sequentially crushing individual cans and employing magnetic means to separate steel containers from containers composed of other materials.

U.S. Pat. No. 4,119,024 devotes primary emphasis to elimination of the creation of an undesired lip at the top or bottom of a can. It also discloses individual sequential crushing of containers followed by a magnetic separation.

U.S. Pat. No. 4,179,018 discloses a consumer operated machine which is adapted to sequentially crush individual aluminum beverage cans and compensate the one making the deposit.

It has previously been suggested to provide ribs depending from a platen with the ribs serving to deform the upper surface of each charge of cans to be compacted in order to effect mechanical jointure of successive charges of cans.

It has also been suggested to provide a compacted can unit with relief to permit engagement by a fork lift but the apparatus and method for creating such a structure has not been suggested.

In spite of the prior efforts to facilitate automated processing of metal containers so as to reduce the volume occupied by the used containers during handling, storage and shipment, there remains a very real and substantial need for equipment which will automatically and economically create compact, high density blocks containing a large number of cans.

SUMMARY OF THE INVENTION

The above described need has been met by the apparatus and method of the present invention. In general, the compactor of the present invention provides a housing and a first ram which is power driven and adapted to effect reciprocating movement within a compaction chamber so as to mechanically bond a plurality of metal containers into a unitary structure. Supply means are provided for delivering a predetermined amount of the used containers, such as aluminum cans, for example, into the compaction chamber. In a preferred embodiment several charges from the supply means will be sequentially compacted in order to create a compacted unit.

The system contemplates providing a second power operated ram which will provide automatic discharge of the compacted unit of cans from the compactor.

The floor of the compaction chamber may serve as the ceiling of the discharge chamber and be moveable simultaneously with the second ram so as to permit entry of the compacted unit into the discharge chamber under the influence of gravity and subsequent power discharge of the compacted unit while simultaneously restoring the compaction chamber floor to its initial position.

It is an object of the present invention to provide apparatus for crushing metal containers and forming them into a compacted unit wherein automated delivery of the compacted unit from the compaction chamber to a discharge chamber and then to the exterior of the compactor is effected.

It is a further object this invention to provide such apparatus wherein the compactor is adapted to receive sequentially several charges of metal containers and compact them into a single compacted unit.

It is a further object of the invention to provide means for providing a predetermined charge of containers of a given weight to the compaction chamber.

It is a further object of the present invention to provide apparatus and a method for deformation of the upper surface of the compacted unit so as to facilitate inversion of the unit and engagement of the deformations by a fork lift.

These and other objects of the invention will be more fully understood from the following description of the invention on reference to the illustrations appended hereto.

DESCRIPTION OF THE PREFERRED EMBODIMENT

Figure 1:
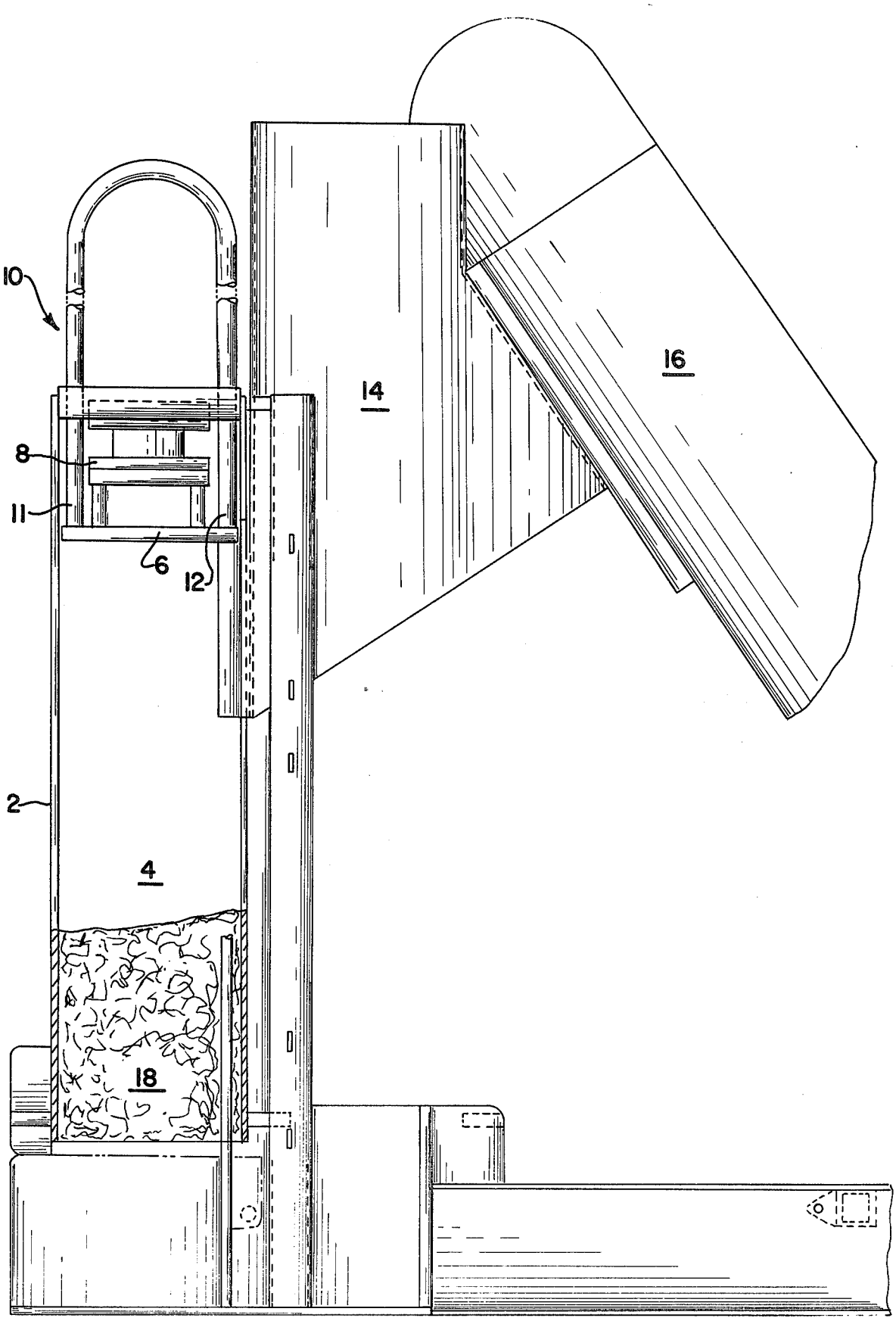
FIG. 1 is a partially schematic elevational view partially in section of a form of compactor of the present invention.
Figure 2:
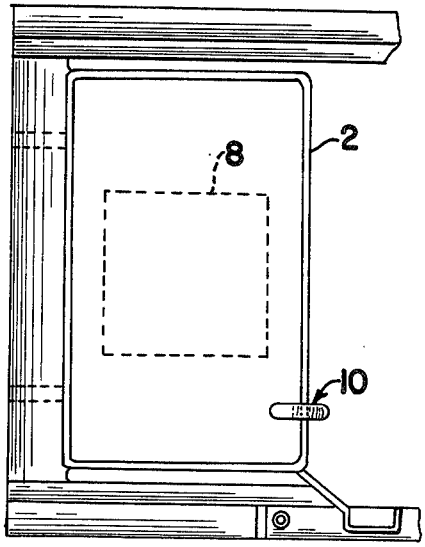
FIG. 2 is a top plan view of the compactor illustrated in FIG. 1.

Referring now in greater detail to FIGS. 1 and 2 there is shown a housing 2, which in the form shown has a generally rectangular exterior configuration. A compaction chamber 4 is defined by the housing. A platen 6 which is secured to a ram 8 is adapted to be reciprocated within the compaction chamber 4 at the desired pressures by any suitable means such as hydraulic or pneumatic fluid systems (not shown). As the means for reciprocating the ram may be any conventional means and will be well known to those skilled in the art, the details of the same need not be described herein.

A trombone tube 10 has one end 11 secured to the platen 6 and the other end 12 disposed over the exterior of the machine. When the platen 6 reciprocates this will effect responsive movement of the trombone tube 10 and provide an indication of platen position. If desired, one or more limit switches may be positioned to contact tube 10 at portion 12, for providing an electrical indication of platen position.

In operation of the system, charges of metal containers which are to be compacted in chamber 4 will be delivered from feed hopper 14 in a manner to be described hereinafter. The containers advantageously may be supplied to the feed hopper 14 from a suitable storage hopper (not shown) which cooperates with conveyor 16 to deliver the containers to the feed hopper 14. It will generally be preferred to employ an endless belt conveyor which has a plurality of upstanding cleats dividing the belt into sections. It is also preferred that the conveyor be at least partially magnetic so as to cause steel containers to be retained thereon in order that they must be removed therefrom on the return reach of travel of the endless conveyors, while aluminum or other nonmagnetic materials may be dropped under the influence of gravity from the highest point of travel of the endless conveyor 16 into the feed hopper 14.

In general, it is contemplated that a plurality of charges of containers from the feed hopper 14 to the compaction chamber 4 will be individually and sequentially compacted so as to provide a compacted unit from the series of charges. For example, if one were to provide six charges per compacted unit a first charge would be introduced from a feed hopper 14 into the compaction chamber 4 and the ram 8 would be lowered so as to compact the containers between the undersurface of the platen 6 and the compaction chamber floor 18. The platen 6 under the influence of the upward movement of the ram 8 would then be raised and a second charge of containers would be introduced from feed hopper 14 into the compaction chamber 4. The ram is then lowered at a predetermined pressure so as to compact the loose cans and create a mechanical unit from the first two charges. Similar procedure would be followed with additional charges. By knowing the size of the compaction chamber 4 interior and establishing the weight of containers per charge and the pressure of the descending ram one may create a compacted unit of containers of predetermined size, shape and density. It is generally preferred to have a compaction chamber of sufficient size to create a compacted unit having a weight of about 20 to 50 pounds.

Figure 3:
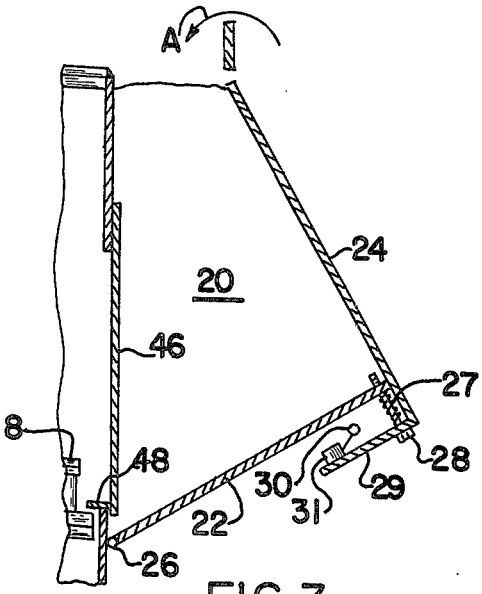
FIG. 3 is a perspective view of a form of a feed hopper usable in the present invention.

Referring now to FIG. 3 there is shown a preferred form of feed hopper 14. Inside the housing 14 shown in FIG. 1 there is a receiver which consists of a base 22, a rear wall 20, a front wall (not shown) which may be substantially the same as the rear wall 20. These elements cooperate with the door 46 and wall 24 to define a chamber for receipt of a change of cans to be compacted. The conveyor (not shown in this view) may supply cans to the receiver through an open top as is generally indicated by arrow A.

Base member 22 is pivoted about hinge 26. A helical spring 27 has a bolt 28 passing therethrough and is threadedly engaged with stop plate 29 which is secured to the lower end of wall 24 and through base 22. By adjusting the position of bolt 28, a corresponding adjustment in tension of spring 27 is effected. The tension in spring 27 will determine what weight of cans must be present in chamber 22 in order for base 22 to contact the contact rod 30 of limit switch 31 thereby switching off the conveyor 16. When door 46 has opened, the predetermined quantity of cans will be delivered to the compaction chamber 4 and the spring 27 will urge the base 22 upwardly to cause spring biased contact rod 30 to move upwardly and initiate further operation of the conveyor (While one spring 27 has been illustrated, it will be appreciated that additional springs spaced along the base 22 may be employed if desired). In this fashion, a series of charges of cans of a predetermined weight may be introduced sequentially to the compacting chamber 4.

It will be appreciated that the operation of the ram moving downwardly to compact a given charge will be coordinated with the supply from the feeder hopper 14. For example, if a compacted unit was intended to be made from four charges of 10 pounds each of cans, after compaction of the fourth charge the compacted unit would be completed and be in the form of a mechanically interconnected unitary member ready for transport out of the compaction chamber 4.

Figure 4:
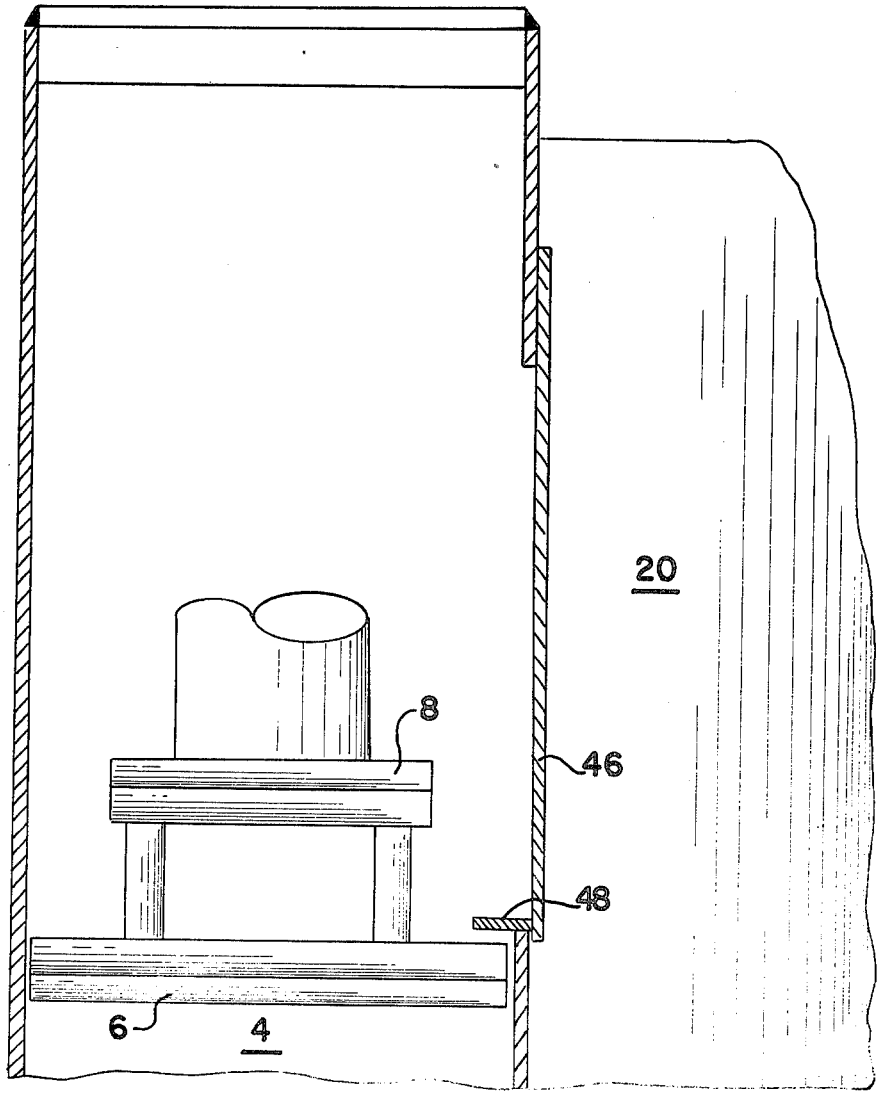
FIG. 4 is a partial cross sectional illustration showing interaction between the platen and access door with the door in a closed position.
Figure 5:
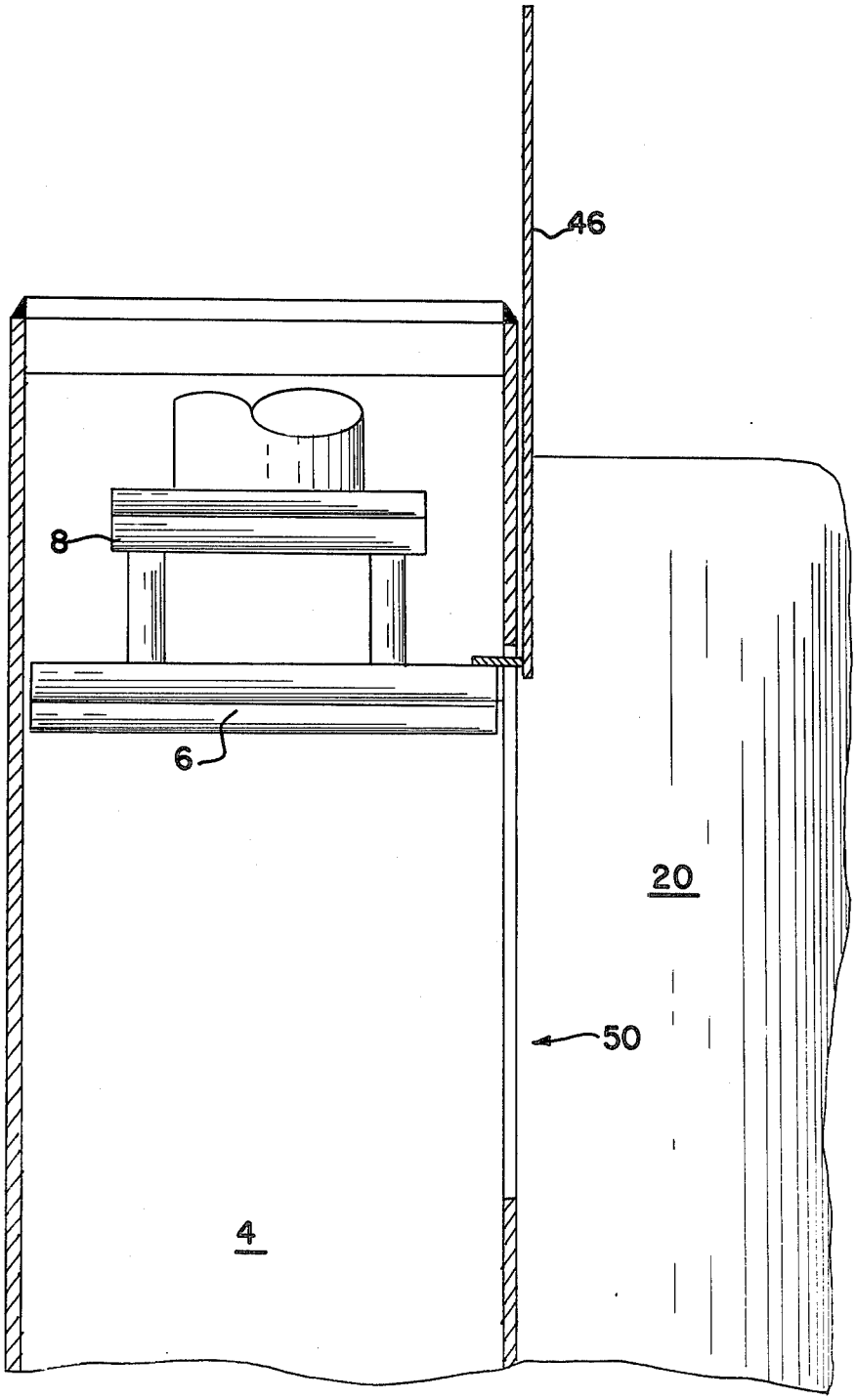
FIG. 5 is similar to FIG. 4 but shows the platen and access door in the open position.

Referring now to FIGS. 4 and 5 a further feature of the invention will now be considered. Sliding door member 46 is adapted to be moved mechanically as a result of contact with platen 6 to create and terminate communication between the feed hopper 14 and the compaction chamber 4. As the ram 8 moves upwardly as shown in FIG. 4, it will engage a projecting flange 48 of the door 46 with continued upward movement serving to slide the door upwardly permitting the opening 50 to establish communication between the feed hopper 14 and compaction chamber 4. After the charge of metal containers, such as aluminum cans, for example, has been delivered into the compaction chamber, the ram moves downwardly under the predetermined pressure thereby permitting the door 46 to move downwardly under the influence of gravity to the closed position. In this fashion, communication between the feed hopper 14 and the compaction chamber 4 is precluded during the compaction stage. If the apparatus is oriented angularly with respect to the vertical or horizontally it will generally be advantageous to secure flange 48 to platen 6, as by welding or mechanical fasteners, for example.

Figure 6:
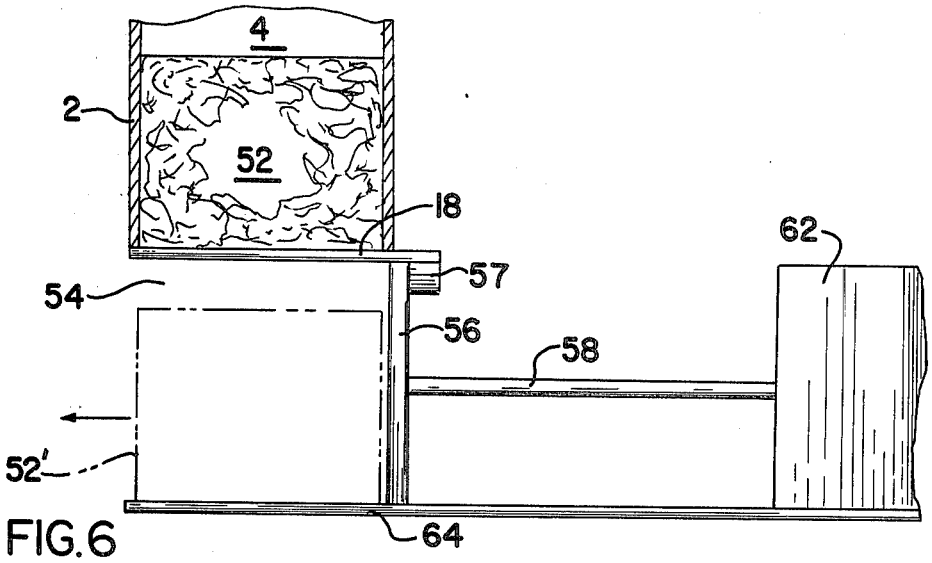
FIG. 6 is a fragmentary, partially schematic, cross sectional illustration showing the discharge chamber and a portion of the compaction chamber.

Referring now to FIGS. 1 and 6 further handling of the compacted unit will now be considered. As is shown in FIG. 6, a compacted unit 52 which, in the form shown, has six generally rectangular faces and may be considered to be of generally cubed shape has been completed in the manner described above and is resting on floor member 18. Discharge chamber 54 is in generally underlying relationship with respect to the compaction chamber 4. Floor 18 of compaction chamber 4 also serves as a ceiling for the discharge chamber 54. A ram 56 is rigidly secured to floor 18 by connector member 57 in order that the two may move as a unit. In the form shown, the ram 56 is caused to reciprocate in a generally horizontal direction as shown in FIG. 6 by means of connecting rod 58 which is secured to hydraulic or pneumatic cylinder 62 in the form shown, ram 56 moves in a path which is oriented generally perpendicular to the path of movement of ram 8. As the rod 58 is retracted into the cylinder 62, floor 18 will be moved to the right so as to provide communication between compaction chamber 4 and underlying discharge chamber 54. The compacted unit 52 will move, preferably under the influence of ram 8 to the dotted position (52) shown wherein it is resting on base 64. As the rod 58 is moved out of cylinder 62 the ram moves to the left thereby urging the compacted unit 52' out of the compactor. This same action restores the floor 18 to its original position sealing off communication between compactor 4 and discharge chamber 54. In this fashion automatic movement of the compacted unit 52 out of the compaction chamber and subsequently out of the compactor is effected in an automatic, rapid and efficient manner.

Figure 7:
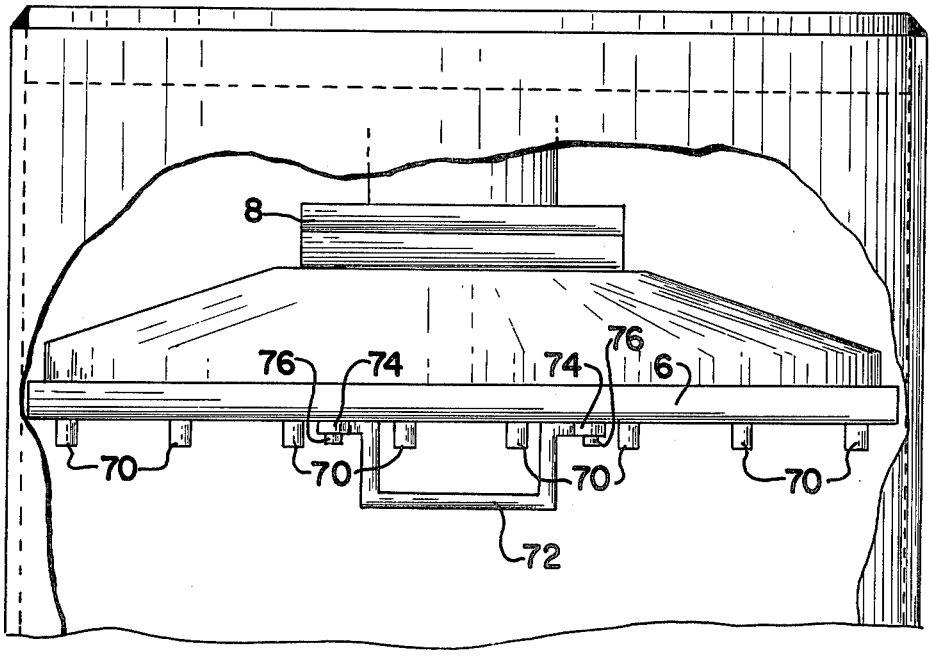
FIG. 7 is a front elevational view of a portion of the compactor showing a form of platen usable in the present invention.
Figure 8:
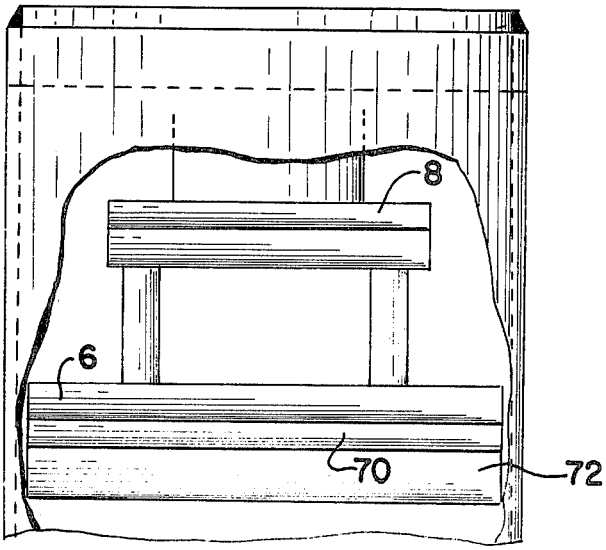
FIG. 8 is similar to FIG. 7, but illustrating a side view.

With reference to FIGS. 7 and 8 a feature, which while not forming a part of the present invention per se, can provide an added advantage to be used therewith will now be considered. The undersurface of the platen 8 is provided with a series of downwardly projecting irregularities, which in the form shown, are a series of elongated, generally straight ribs 70. The primary function of these ribs is to deform the upper surface of each charge of cans as it is compacted into a mechanically retained unit. As these ribs 70 form upwardly open recesses in each successive charge the next succeeding charge is, in part, forced into these depressions thereby creating a mechanical interfit between successive charges. As a result, where four successive charges are to be compacted the upwardly open recesses provided in the first three charges upon compaction would subsequently be mechanically interengaged with the next succeeding charge as it was compacted. This serves to contribute significantly to the unitary mechanical nature of the compacted unit. While for convenience of illustration the preferred use of a series of generally parallel elongated ribs 70 has been shown, it will be appreciated that other configurations may be employed if desired.

Figure 9:
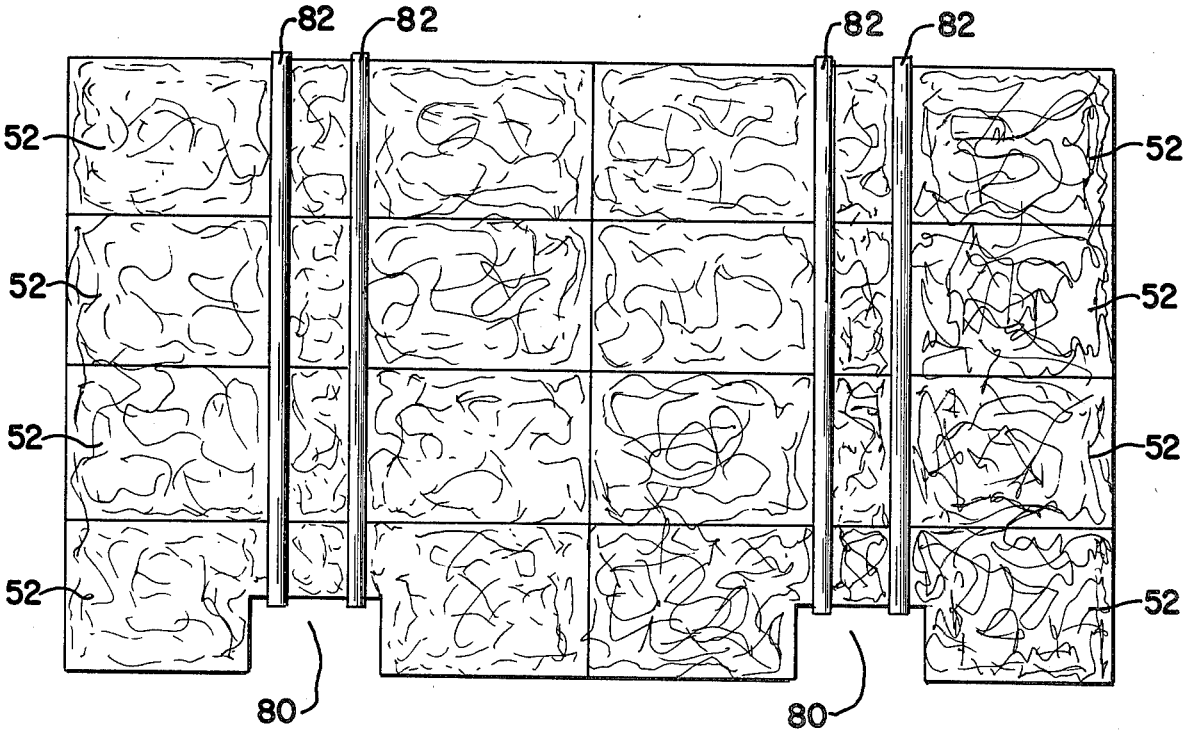
FIG. 9 is a partially schematic elevational view of two bundles of compacted can units in accordance with an embodiment of this invention.

Referring still to FIGS. 7 and 8 an additional feature of the apparatus and method of the invention will be considered. This feature eliminates the need to place a group of compacted units on a pallet in order to permit a fork lift to transport them. In this embodiment, a downwardly projecting upwardly open channel shaped member 72 is demountably secured to the platen 6, as by bolts 76 passing through openings in flange 74. Member 72 will provide an indentation substantially larger than ribs 70, preferably extending the full width of compacted unit 52. It may, for example, have a width of about 8 inches and a height of about 2–3 inches. As is shown in FIG. 9 the unit 52 with recesses 80 established by member 72 are placed under the units 52 and straps 82 are employed to secure the bundles. A fork lift may then engage recesses 80 for movement of the bundles, while one member 72 has been shown secured to platen 6, two or three or more may be employed, if desired.

It will be appreciated that in the method of the present invention with reference to the best mode of apparatus as described above, one would supply a predetermined charge of metal containers, such as aluminum cans, for example, into the compaction chamber. A first ram would compress the first charge of metal containers into a mechanically retained unit. One would supply at least one additional charge and subsequently compact the same by the first ram so as to form a unitary structure of all the charges introduced. One subsequently removes the floor means to permit the compacted unit to enter the discharge chamber and employs a second ram to restore the floor to closed position and move the compacted unit out of the compactor.

While for convenience of reference herein the apparatus has been illustrated as having a compaction chamber which is oriented in a vertical direction, it will be appreciated that apparatus may be so positioned that the compaction chamber may be horizontally or angularly disposed, if desired.

While for convenience of reference herein reference has been made specifically to creating a unitary structure from metal containers such as aluminum cans, it will be appreciated that other types of containers such as steel cans may similarly be compacted by the present invention should such action be desired.

Whereas particular embodiments of the invention have been described above for purposes of illustration, it would be evident to those skilled in the art that numerous variations of the details may be made without departing from the invention as defined in the appended claims.

We claim:

1. Apparatus for crushing containers comprising a housing having a compaction chamber, a first ram having a platen secured thereto for crushing said containers into a compacted unit, power means for effecting reciprocating movement of said platen within said compaction chamber, supply means for delivering containers to said compaction chamber, a discharge chamber disposed generally adjacent to said compaction chamber, movable floor means for separating said compaction chamber from said receiving chamber, whereby when said floor means is in an open position a compacted unit of a plurality of said containers can be transferred from said compaction chamber to said discharge chamber, second power operated ram means for urging said compacted unit out of said discharge chamber, said second ram means mounted for movement in a path generally perpendicular to the path of movement of said first ram, recess creating means secured to said platen, and said recess creating means being of sufficient size to receive bundling straps for fork lift handling of said compacted units.

2. The apparatus of claim 1 wherein said supply means includes conveyor means and feed hopper means for receiving metal containers from said conveyor means, and said feed hopper means having means for delivering a predetermined amount of said containers to said compaction chamber.

3. The apparatus of claim 2 wherein said feed hopper means has means for measuring a predetermined weight of said containers.

4. The apparatus of claim 3 including
movable door means connecting said feed hopper means with a compaction chamber, and
door operating means for opening and closing said door means responsive to movement of said first ram.

5. The apparatus of claim 4 including
said door means having at least one projection extending into said compaction chamber sufficiently far to be engaged by said platen, whereby upward movement of said platen in a first direction will result in responsive movement of said door to establish communication between said feed hopper means and said compaction chamber and downward movement of said platen in a second direction will cause said door means to move to a closed position.

6. The apparatus of claim 3 wherein
said conveyor means has magnetic means for resisting delivery of containers composed of magnetic material to said feed hopper means.

7. The apparatus of claim 6 including
said feed hopper means being adapted to deliver about five to twenty pounds of aluminum cans per batch to said compaction chamber.

8. The apparatus of claim 3 including
said compaction chamber having a container capacity of at least twice the quantity which said feed hopper means can deliver at one time, whereby a said compacted unit created by sequential compactions of at least two charges from said feed hopper means can be provided.

9. The apparatus of claim 8 including
said compaction chamber is of sufficient size to create a compacted unit composed of aluminum cans and having an overall weight of about 20 to 50 pounds.

10. Apparatus for crushing containers comprising
a housing having a compaction chamber,
a first ram having a platen secured thereto for crushing said containers into a compacted unit,
power means for effecting reciprocating movement of said platen within said compaction chamber,
supply means for delivering containers to said compaction chamber,
a discharge chamber disposed generally adjacent to said compaction chamber,
movable floor means for separating said compaction chamber from said receiving chamber, whereby when said floor means is in an open position a compacted unit of a plurality of said containers can be transferred from said compaction chamber to said discharge chamber,
second power operated ram means for urging said compacted unit out of said discharge chamber,
said second ram means mounted for movement in a path generally perpendicular to the path of movement of said first ram,
recess creating means secured to said platen, and
said recess creating means being of sufficient size to create fork lift engageable recesses in said compacted unit.

11. The apparatus of claim 10 including said recess creating means being demountably secured to said platen.

12. A method of making a compacted unit of crushed metal containers comprising
providing a compactor having a housing, a compaction chamber, a first power operated ram having a platen secured thereto, means for reciprocating said ram in said compaction chamber, a discharge chamber, a movable floor separating said compaction chamber from said discharge chamber, and a power operated second ram for moving said compacted unit of metal containers out of said discharge chamber,
supplying a predetermined charge of metal containers to said compactor chamber,
moving said first ram toward said movable floor to compress said charge of metal containers,
supplying at least one further said charge of containers,
after each said charge is introduced into said compaction chamber compacting said charge to establish a compacted container unit composed of all of the said containers in said compaction chamber,
moving said floor means to permit said compacted unit to enter said discharge chamber,
employing said second ram to move said compacted unit out of said compactor,
simultaneously with the movement of said compacted unit out of said discharge chamber moving said floor to a closed position,
employing said process with nonferrous cans, and
providing by recess creating means secured to said platen at least one recess in the upper surface of said compacted unit, with said recess being of sufficient size to receive bundling straps for fork lift handling of said compacted units.

13. The method of claim 12 including
simultaneously with the movement of said compacted unit out of said discharge chamber moving said wall to a closed position.

14. The method of claim 13 including
employing said process with nonferrous cans.

15. A method of making a compacted unit of crushed metal containers comprising
providing a compactor having a housing, a compaction chamber, a first power operated ram having a platen secured thereto, means for reciprocating said ram in said compaction chamber, a discharge chamber, a movable floor separating said compaction chamber from said discharge chamber, and a power operated second ram for moving said compacted unit of metal containers out of said discharge chamber,
supplying a predetermined charge of metal containers to said compactor chamber,
moving said first ram toward said movable floor to compress said charge of metal containers,
supplying at least one further said charge of containers,
after each said charge is introduced into said compaction chamber compacting said charge to establish a compacted container unit composed of all of the said containers in said compaction chamber,
moving said floor means to permit said compacted unit to enter said discharge chamber,
employing said second ram to move said compacted unit out of said compactor,
simultaneously with the movement of said compacted unit out of said discharge chamber moving said floor to a closed position,
employing said process with nonferrous cans, and
providing by recess creating means secured to said platen at least one recess in the upper surface of said compacted unit, with said recess being of sufficient size to be engageable by a fork lift, whereby said recess may be engaged by a fork lift without requiring the use of a pallet.

* * * * *

UNITED STATES PATENT AND TRADEMARK OFFICE

CERTIFICATE OF CORRECTION

PATENT NO. : 4,483,246

DATED : November 20, 1984

INVENTOR(S) : Patrick J. Sullivan, Richard J. White, Lloyd M. Bigley

It is certified that error appears in the above-identified patent and that said Letters Patent is hereby corrected as shown below:

Column 5, line 19, "(52)" should be --(52')--.

Column 5, line 30, "per se" should be --per se--.

Signed and Sealed this

*Thirteenth* Day of *August 1985*

[SEAL]

*Attest:*

DONALD J. QUIGG

*Attesting Officer* *Acting Commissioner of Patents and Trademarks*